United States Patent [19]

Kani et al.

[11] Patent Number: 4,811,158

[45] Date of Patent: Mar. 7, 1989

[54] SOLID STATE CHARGER

[75] Inventors: Yasuyuki Kani, Yasu; Eishu Ohdake, Yokohama; Seiichi Miyakawa, Nagareyama, all of Japan

[73] Assignees: Ricoh Company, Ltd., Tokyo; Noritake Co., Limited, Nagoya, both of Japan

[21] Appl. No.: 208,860

[22] Filed: Jun. 14, 1988

Related U.S. Application Data

[63] Continuation of Ser. No. 906,499, Sep. 12, 1986, abandoned.

[30] Foreign Application Priority Data

Sep. 17, 1985 [JP] Japan ..... 60-203288

[51] Int. Cl.[4] ..... H01T 23/00

[52] U.S. Cl. ..... 361/230; 361/225

[58] Field of Search ..... 361/213, 214, 225, 230, 361/229; 355/3 CH; 346/159

[56] References Cited

U.S. PATENT DOCUMENTS 4,057,723 11/1977 Sarid et al. ..... 361/225 X 4,435,066 3/1984 Tarumi et al. ..... 346/159

*Primary Examiner*—L. T. Hix

*Assistant Examiner*—D. Rutledge

*Attorney, Agent, or Firm*—Oblon, Fisher, Spivak, McClelland & Maier

[57] ABSTRACT

A solid state charger having covered electrodes with dielectric and uncovered discharge electrodes disposed parallel to each other. The covered electrodes and the discharge electrodes are both disposed on the same surface of an insulating substrate. An ac voltage is applied between the covered electrodes and the discharge electrodes, or between the covered electrodes, and a dc voltage is applied to the discharge electrodes.

6 Claims, 3 Drawing Sheets

SOLID STATE CHARGER

This application is a continuation of application Ser. No. 06/906,499 filed on Sept. 12, 1986, now abandoned.

FIELD OF THE INVENTION AND RELATED ART STATEMENT

This invention relates to a solid state charge in use for charging or discharging photosensitive members or the like in electrostatic recorders.

In place of the fine wired corona discharger conventionally used for charging or discharging photosensitive members in electrophotographic copying machines, printers, facsimiles and other electrostatic recorders, solid state chargers (hereafter referred to as SSC) have been put to practical use, since they are highly reliable, extremely reserviceable, compact and responsive to high speed.

A variety of configurations have been proposed for SSCs charging and discharging a charged surface of photosensitive member by corona discharging.

One of the inventors of the present invention has proposed a configuration of SSC as shown in FIG. 3, in order to take advantage of the advancement of withstand voltage characteristics and the inherent advantage of maintaining a uniform distribution of charges even under reduced frequency applied.

This SSC 10 as shown in FIG. 3 has a pair of covered electrodes 12*a* and 12*b* disposed at an interval great enough so as not to initiate discharging and placed between an insulating substrate 15 and a dielectric layer 14, as well as a pair of uncovered discharge electrodes 13*a* and 13*b* disposed on the dielectric layer 14 respectively facing aforesaid pair of covered electrodes 12*a* and 12*b*. Application of an ac voltage with an ac supply between the covered electrodes 12*a* and 12*b* induces an ac current which flows from the covered electrode 12*a* to the another covered electrode 12*b* through the dielectric layer 14, the discharge electrodes 13*a* and 13*b* and the other dielectric layer 14, when corona discharging takes place between the vicinity of the discharge electrodes 13*a* and 13*b* and the surface of the dielectric layer 14 adjacent to this portion, to produce positive and negative ions. In the use of SSC 10 for charging or discharging a charged surface of photosensitive member, SSC 10 is so disposed that the discharging surface should face the charged surface 42 at a distance apart and parallel to each other and a dc bias supply 41 be connected between the discharge electrodes 13*a* and 13*b* and the electrode of the charged surface 42 to form a dc electric field between them. Then the ions produced by aforesaid corona discharge will advance toward the charged surface 42 to carry charged current between charged electrodes, thus resulting in charging or discharging the charged surface.

In this configuration, a capacitance directly proportional to the area of the discharge electrodes 13*a* and 13*b* and inversely proportional to the thickness of the dielectric layer 14, is present between the covered electrodes 12*a* and 12*b*, which makes the capacity load of SSC 10 larger. Therefore, the configuration requires a large supply current to discharge SSC 10, thus resulting in an increase in the cost of the power supply. To overcome this drawback, the capacity ought to be made smaller by increasing the thickness of the dielectric layer 14, but when the layer is formed by the process of glass coating or glazing, the thickness cannot be formed thicker than a limit of some 200 mu. Furthermore, an increase in thickness of the dielectric layer 14 involves an increase in discharge voltage. From the above mentioned view point, increase of the thickness of the dielectric layer 14 could not exactly be advisable.

Another configuration of SSC 20 in the prior art has been proposed as shown in FIG. 4, where a bank of corona discharging electrodes 23 is placed on one surface of a flat dielectric layer 24, another bank of opposite electrodes 22 is placed on the other surface of the layer 24 parallel to each other and in a staggering relation, another dielectric layer 25 is also disposed behind the opposite electrodes 22, and an ac high-frequency, high-voltage power supply is connected to the opposite electrodes 22 through protective resistance. For example, a glass plate 1 mm thick is used for the dielectric layer 24, another glass plate 2 mm thick for the other layer 25, and tungsten wires approximately 0.1 mm in diameter are used for the corona discharge electrodes, copper wires approximately 1 mm for the opposite electrodes 22, and both wires respectively are disposed at intervals of 10 mm. Numeral 26 is a bonding agent to adhere the dielectric layer 24 and the other layer 25 to each other.

This configuration can provide a smaller capacity, but has following drawbacks:

In the manufacture of the device as shown in FIG. 4 using for instance the present printing technique, the bank of opposite electrodes 22 is printed on a surface of the dielectric layer 25, the bank of discharge electrodes 23 on a surface of the layer 24, and then both dielectric layers 24 and 25 must be bonded to each other with bonding agent, thus complicating the manufacture process, resulting in an increase in cost associated with the complex process. And further, the distance between both electrodes 22 and 23, g′ in FIG. 4 must be equal over the length of SSC 20 for uniform discharging, but the manufacture process resorting to the above mentioned steps would readily introduce an offset of several 10 um due to positional setting errors in the bonding operation. Such drawbacks as previously mentioned may not be eliminated in any manufacture process as long as the configuration remains as shown in FIG. 4. let along the above mentioned manufacture process.

OBJECT AND SUMMARY OF THE INVENTION

It can be said that the purpose and object of this invention is to provide a SCC which makes the capacity load of the device smaller as well as realizes a high precision in simple manufacture process, in view of aforesaid drawbacks associated with the prior art of SSC.

To achieve aforesaid purpose, a SCC according to the invention having covered electrodes with dielectric and uncovered discharge electrodes disposed parallel to aforesaid converted electrodes is characterized by both the aforesaid covered electrodes and discharge electrodes being disposed on the same surface of an insulating substrate.

DETAILED DESCRIPTION OF PREFERRED EMBODIMENT

Figure 1:
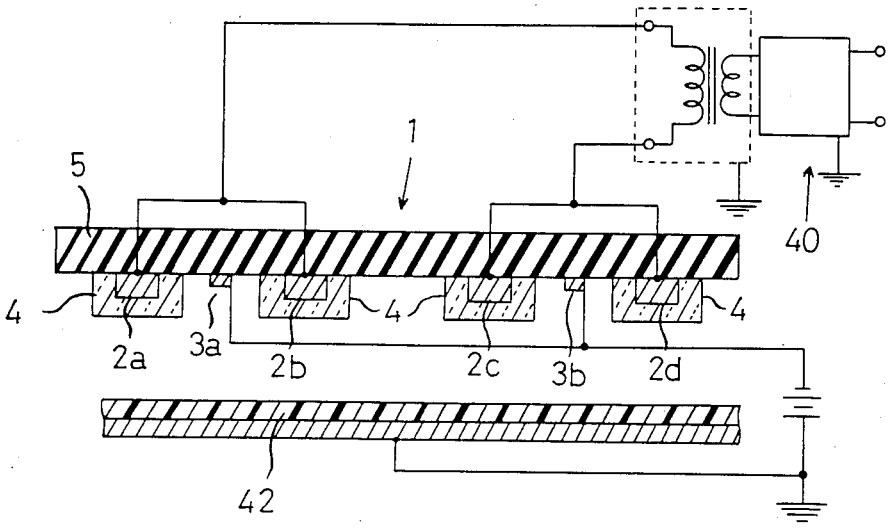
FIG. 1 is a schematic sectional drawing showing a configuration of an embodiment according to the invention.

Referring now in detail to the illustrative embodiments according to the invention:

FIG. 1 is a sectional drawing showing an embodiment according to the invention. SSC 1 according to the embodiment provides covered electrodes *2a, 2b, 2c,* and *2d* as well as uncovered discharge electrodes *3a* and *3b* on a same surface of an insulating substrate 5, which are disposed parallel to each other and keep given distances from each other in a longitudinal direction of the SSC 1. The covered electrodes *2a, 2b, 2c* and *2d* are separately covered with dielectric 4. The covered electrodes 2a and 2b are connected to one terminal of an ac high-frequency power supply 40, the covered electrodes *2c* and *2d* to the other terminal, and the discharge electrodes *3a* and *3b* are disposed respectively between the covered electrodes *2a* and *2b*, and between *2c* and *2d*, as well as are connected to a terminal of a dc supply 41. SSC 1 is so arranged that the surface provided with aforesaid two kinds of banks of electrodes be faced to a charging surface of a substance to be charged 42 such as a photosensitive member, and the other terminal of the dc supply 41 to be connected to an electrode of the substance to be charged 42.

When an ac voltage is applied to the SSC by the ac power supply 40, corona discharging takes place between the covered electrodes *2a* and *2b* and the discharge electrode *3a* as well as between the covered electrodes *2c* and *2d* and the discharge electrode *3b*, to generate positive and negative ions. Then, by applying a dc voltage between the discharge electrode *3a* and *3b* and the substance to be charged 42 with the dc supply 41, the substance to be charged 42 can be charged to a desirable polarity.

Figure 2:
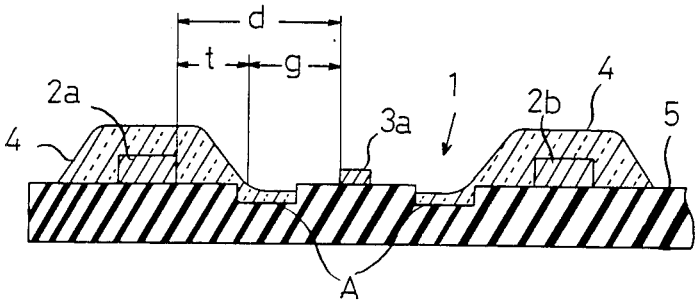
FIG. 2 is a sectional drawing showing in more detail a part of FIG. 1.
Figure 3:
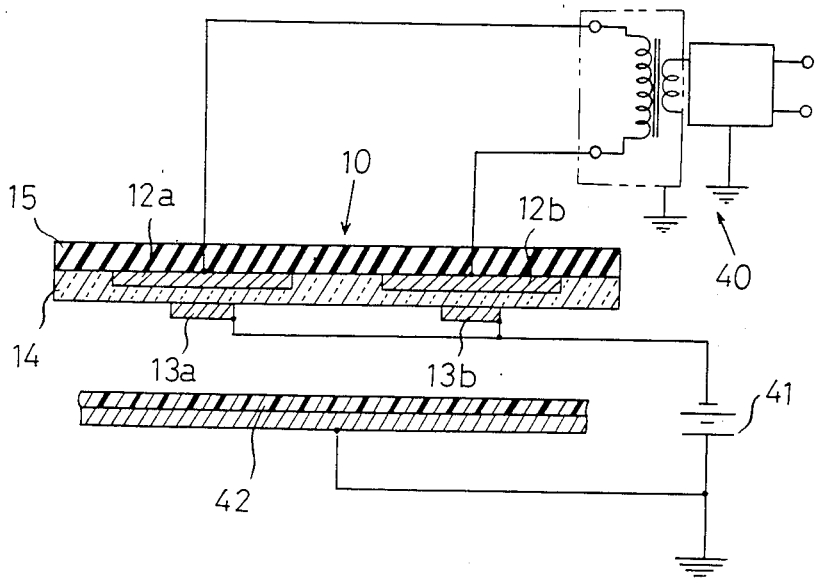
FIG.3 PRIOR ART
FIGS. 3 and 4 are schematic sectional drawings showing the prior art.
Figure 4:
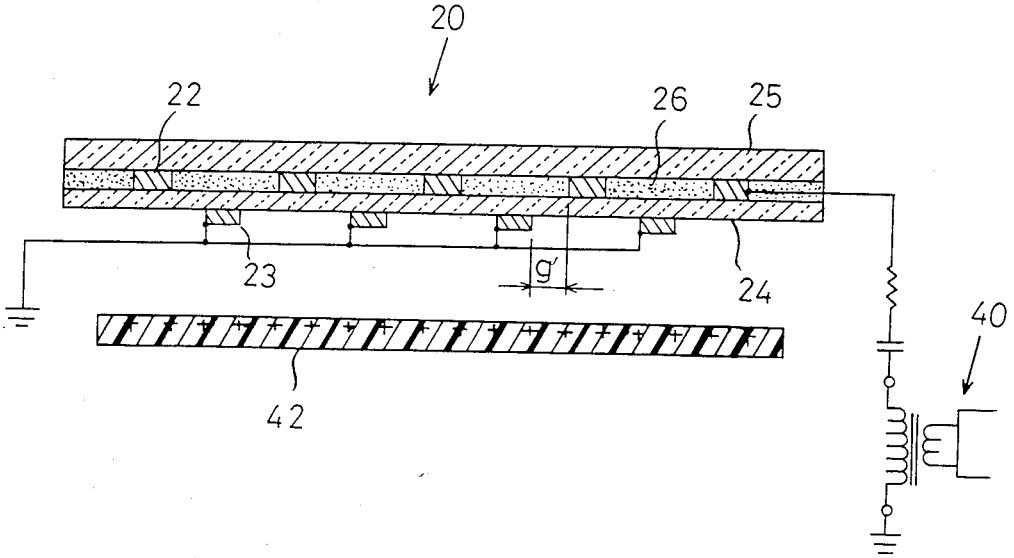
FIG. 4 PRIOR ART
Figure 5:
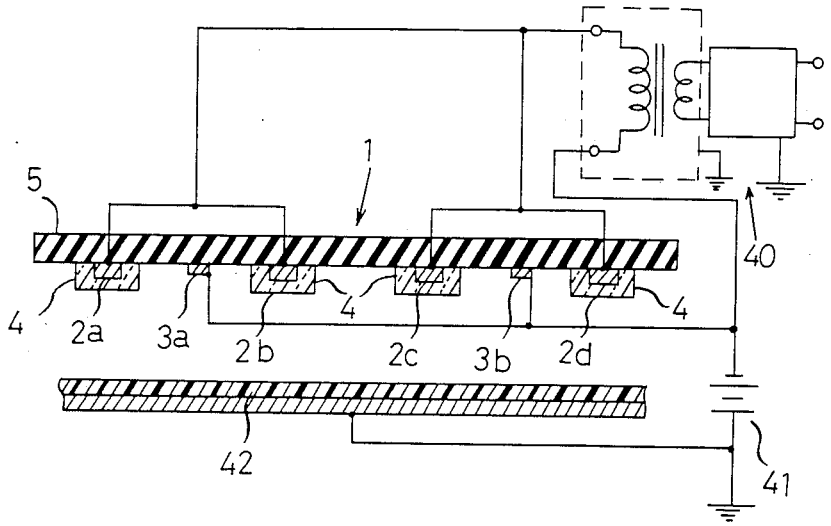
FIG. 5 is a schematic sectional drawing showing another embodiment according to the invention.

FIG. 2 shows in more detail a part of the SSC according to aforesaid embodiment. Letter d is a distance between a covered electrode (for instance *2a*) and an adjacent discharge electrode (for instance *3a*). t the thickness of the dielectric layer 4, g an air gap between the dielectric layer *4a* and a discharge electrode, where the value of d must be constant over the length of the SSC, preferably approximately 300 to 500 um. Since the bank of covered electrodes and the bank of discharge electrodes are on the same surface of the insulating substrate 5 in the SSC according to the invention, these banks can be manufactured at the same time by the use of screen printing or etching process, thus eliminating the need for exacting positioning, so that the distances between both kinds of electrodes can be set to as precisely as some um. The dielectric layers 4 are formed by baking glass frit screen printed usually with a thickness t of 100 to 200 um. Because paste will sag down in the formation of the dielectric layer 4, the skirt will widen in all probability, thus being likely to reach as far as the discharge electrode. In this case, a provision of grooves with a suitable width and depth between the covered and discharge electrodes can guide surplus paste to flow into the grooves, thus keeping it from reaching the discharge electrodes. By the way, in the embodiment as shown in FIG. 1, an ac voltage is applied only between electrodes covered with dielectric layers 4, but as shown in FIG. 5, an ac voltage may be applied between covered and discharge electrodes, with the discharge electrodes also applied by a dc voltage for a desirable function.

As mentioned above, according to the invention, both banks of electrodes can be formed simultaneously by the use of screen printing or etching process, thus enhancing its productivity as well as keeping precise spacing of electrodes and eliminating the uneven discharge. Furthermore, since capacity load can be made extremely small, the SCC according to the invention can operate under low current.

The above mentioned electrodes are formed into thick films by screen printing, etc., but they may be formed into thin films with the same effect.

It will be obvious to those skilled in the art that various changes may be made in the invention without departing from the spirit and scope thereof and therefore the invention is not limited by that which is shown in the drawings and described in the specification but only as indicated in the appended claims.

What is claimed is:

1. A solid state charger having electrodes covered with dielectric and uncovered discharge electrodes disposed parallel to each other comprising:

said covered electrodes and said discharge electrodes being disposed on a same surface of the insulating substrate;

wherein grooves are provided between said covered electrodes and said discharge electrodes in the surface of said insulating substrate.

2. The solid state charger as claimed in claim 1 wherein an ac voltage is applied between said first electrodes and said second electrodes.

3. The solid state charger as claimed in claim 1 wherein an ac voltage is applied between said first electrodes.

4. The solid state charger as claimed in claim 2 or 3 wherein a dc voltage is applied to said second electrodes.

5. The solid state charger as claimed in claim 1 wherein grooves are provided between said first electrodes and said second electrodes in said surface of said insulating substrate, the bottom of said grooves being below the level of said surface so as to prevent said dielectric layer from reaching said second electrodes.

6. A solid state charge comprising:

an insulating substrate;

a plurality of first electrodes provided directly on an in contact with a surface of said insulating substrate and disposed parallel to each other;

a plurality of second electrodes provided directly on and in contact with said surface of said insulating substrate and disposed parallel to said first electrodes;

a plurality of dielectric layers, with each layer individually covering a corresponding one of said first electrodes, said second electrodes not being in contact with said dielectric layers.

* * * * *